United States Patent [19]

Falk

[11] Patent Number: 4,540,805

[45] Date of Patent: Sep. 10, 1985

[54] DI-PERFLUOROALKYL CARBAMYL GROUP CONTAINING ACRYLATES AND METHACRYLATES

[75] Inventor: Robert A. Falk, New City, N.Y.

[73] Assignee: Ciba-Geigy Corporation, Ardsley, N.Y.

[21] Appl. No.: 655,833

[22] Filed: Oct. 1, 1984

[51] Int. Cl.[3] ..... C07C 125/065; C07C 125/067

[52] U.S. Cl. ..... 560/135; 560/160

[58] Field of Search ..... 560/160, 135

[56] References Cited

U.S. PATENT DOCUMENTS

| | | | |
|---|---|---|---|
| 2,803,656 | 8/1957 | Ahlbrecht et al. | 560/222 |
| 3,445,491 | 5/1969 | Facini | 260/455 R |
| 4,125,671 | 11/1978 | Magazzu | 260/455 A |

FOREIGN PATENT DOCUMENTS 0040923 12/1981 European Pat. Off. .

*Primary Examiner*—Natalie Trousof
*Assistant Examiner*—L. Hendriksen
*Attorney, Agent, or Firm*—Michael W. Glynn

[57] ABSTRACT

Di-perfluoroalkyl containing acrylate and methacrylate monomer derivatives of the formula:

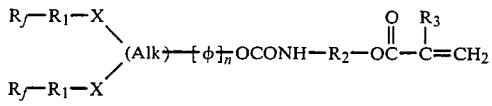

(I)

where $R_f$ is perfluoroalkyl, omega-hydroperfluoroalkyl, or perfluoroalkoxy substituted perfluoroalkyl;

$R_1$ is alkylene of up to 12 carbon atoms:

X is —S— or —$SO_2$—;

Alk is alkanetriyl having from 1 to 12 carbon atoms;

$\phi$ is phenylene which is unsubstituted or substituted by chlorine, bromine, alkyl of 1 to 6 carbon atoms or alkoxy of 1 to 6 carbon atoms;

n is 0 or 1;

$R_2$ is alkylene of up to 12 carbon atoms; and $R_3$ is hydrogen or methyl; their preparation and use as hydrophobic and oleophobic finishes are disclosed.

16 Claims, No Drawings

DI-PERFLUOROALKYL CARBAMYL GROUP CONTAINING ACRYLATES AND METHACRYLATES

BACKGROUND OF THE INVENTION

The instant invention relates to new and useful di-perfluoroalkyl carbamyl group containing acrylate and methacrylate monomers, polymers thereof, and their use in rendering cellulosic, natural, and synthetic polyamide materials hydrophobic and oleophobic.

It is a further object of this invention to provide methods for their preparation. One embodiment of this invention provides a simple economic method of preparing such acrylate and methacrylate monomers.

Various structurally divergent mono-perfluoroalkyl acrylate and methacrylate monomers are known, for example as described in U.S. Pat. Nos. 2,642,416, 3,102,103, 3,282,905, 3,544,663, 3,655,732, and 4,060,681. However, their structure is substantially different from those of the instant invention, and such prior-art preparations invariably entail cumbersome multistep techniques with consequent losses of the costly fluorochemical.

DETAILED DESCRIPTION OF THE INVENTION

The di-perfluoroalkyl containing acrylate and methacrylate monomer derivatives of the instant invention are represented by the formula:

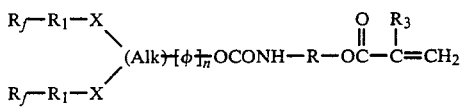

(I)

where $R_f$ is perfluoroalkyl, omega-hydroperfluoroalky, or perfluoroalkoxy substituted perfluoroalkyl;

$R_1$ is alkylene of up to 12 carbon stoms:

X is —S— or —$SO_2$—;

Alk is alkanetriyl having from 1 to 12 carbon atoms;

$\phi$ is phenylene which is unsubstituted or substituted by chlorine, bromine, alkyl of 1 to 6 carbon atoms or alkoxy of 1 to 6 carbon atoms;

n is 0 or 1;

$R_2$ is alkylene of up to 12 carbon atoms; and $R_3$ is hydrogen or methyl.

The $R_f$ group generally contains from 1 to 18 carbon atoms, preferably from 3 to 12 carbon atoms and most preferably from 6 to 12 carbon atoms. The $R_f$ group may be straight or branched chain. Preferred are those $R_f$ group which are perfluoroalkyl and especially advantageous are those wherein the perfluoroalkyl is a mixture therof.

$R_2$ is preferably alkylene of up to 2 to 6 carbon atoms, more preferably straight chain alkylene of 2 to 6 carbon atoms, and most preferably is ethylene.

$R_3$ is hydrogen or methyl, and more preferably $R_3$ is methyl.

X is preferably —S—.

Alk is preferably alkanetriyl of 1 to 7 carbon atoms where n equals 1. In this embodiment, the Rf—$R_1$—X— groups are advantageously bonded to the same carbon atom as the phenylene moiety.

In an alternate embodiment, Alk is preferably

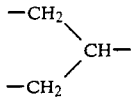

wherein the $R_f$—$R_1$—X— groups are attached to the —$CH_2$— moieties.

In a further alternate embodiment, Alk is alkanetriyl of 2 to 14 carbon atoms, preferably 2 to 6 carbon atoms, the $R_f$—$R_1$—X— groups are attached to the same carbon atom, and n is zero. In this embodiment, the carbamate oxygen is advantageously attached to a carbon other than that to which said $R_f$—$R_1$—X— groups are attached.

In yet a further alternate embodiment, Alk is alkanetriyl of 3 to 14 carbon atoms and the $R_f$—$R_1$—X— attached to adjacent carbon atoms.

Preferably $\phi$ is phenylene or phenylene substituted by methyl or methoxy.

The compounds of formula I are advantageously prepared by reacting a compound of the formula:

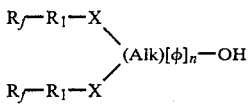

(II)

wherein $R_f$, $R_1$, X, Alk, $\phi$ and n are as defined above; with a difunctional monomer having a reactive isocyanate group and a polymerizable vinyl double of the formula:

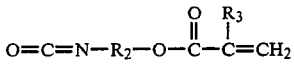

(III)

where $R_2$ and $R_3$ are defined above, at a temperature between −20° C. and 100° C., preferably 10° C. to 50° C., optionally in the presence of an inert solvent, such as petroleum ether, 1,1,2-trichloro-trifluoroethane, methyl ethyl ketone, toluene, 2-ethoxyethyl acetate, hexafluoro-xylene, and the like, Advantageously, this process can be conducted in the presence or absence of a conventional urethane catalyst, such as dibutyltin dilaurate and/or a tertiary amine including tri-alkylamines, di-alkyl aralkylamines, di-alkyl arylamines, N-alkyl heteroamines, aromatic heterocyclic amines, and the like, such as triethylamine, N,N-dimethyl benzylamine, N,N-dimethyl aniline, N-methyl piperidine, or pyridine. Since the reaction proceeds by addition, no coproducts are formed to any appreciable extent, thereby simplifying purification and isolation. In many cases the reaction product may be used without any purification of the desired product. Alternatively, the vinyl monomer may be purified by conventional cyrstallization procedures and obtained by filtration and evaporation.

The starting materials of formulae III are known in the art.

For example, the monomers of formula III are described in U.S. Pat. Nos. 2,718,516 and 2,821,544 and are described in J. Coatings Technology, Vol. 55, (703), pp. 55–61 (1983). Preferred monomers of formula II are those wherein $R_2$ is alkylene of 2 of 6 carbon atoms and $R_3$ is hydrogen or methyl, and include isocyanatoethyl acrylate, isocyanatoethyl methacrylate, isocyanatobutyl acrylate, isocyanatobutyl methacrylate, isocyanatohexyl acrylate, and isocyanatohexyl methacrylate. Isocyanatoethyl methacrylate is a preferred monomer from the standpoint of ease of copolymerization and availability.

The instant $\alpha,\beta$-unsaturated ester monomers of formula (I) are very reactive and having a strong tendency to form homo- or copolymers.

The compounds of formula II are known or can easily be prepared from known compounds by conventional techniques.

Thus, those compounds of formula II where Alk is alkanetriyl of 1 to 7 carbon atoms and n equals 1 are described, for example, in U.S. Pat. No. 4,429,162 which is hereby incorporated by reference in toto.

Further, those compounds of formula II wherein Alk is of the formula

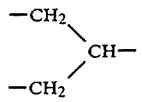

are exemplified in U.S. Pat. No. 3,883,596 which is also hereby incorporated by reference in toto.

Moreover, those compounds of formula II where Alk is alkanetriyl of 2 to 14 carbon atoms, the $R_f$—$R_1$—X— groups are attached to the same carbon atom and n is zero are prepared, inter alia, by the reduction of those mono-carboxylic acids described in U.S. Pat. No. 4,239,915, herein incorporated by reference in toto, to the corresponding alcohols. Such reduction is advantageously and easily accomplished by reaction of stoichiometric amounts of said carboxylic acid with a metal hydride such as lithium aluminum hydride in the presence of an inert solvent or diluent, such as diethyl ether or tetrahydrofuran, at a reaction temperature between about 0° C. to about 80° C., preferably between about 20° C. to 70° C., and recovering the resultant alcohol by diluting the reaction mixture with water and two equivalents of alkali, separating the organic phase from the aqueous phase and evaporating the organic phase to obtain the alchol.

Alternatively, the compounds of formula II can be prepared by reacting the appropriate halo substituted alkyl epoxide with two moles of $R_f$—$R_1$—X—H, where $R_f$ and $R_1$ are as previously defined and X is —S—, in accordance with the procedure set forth in Example 2 of U.S. Pat. No. 3,883,596.

Alternatively, as the starting material, there may be used the di-perfluoroalkylthio alcohols described in U.S. Pat. 4,158,672.

Those thioether alcohols of formula II can be converted into the corresponding sulfone alcohols by selective oxidation of the thio moiety by reaction with a suitable oxidizing agent such as peracetic acid or metachloroperbenzoic acid, using two moles of oxidizing agent per mole of thioether alcohol at about 40° to 100° C. in an inert diluent such as acetic acid, neutralizing the reaction product with aqueous base and evaporating the insoluble sulfone alcohol therefrom.

The polymerization of the $R_f$-acrylate and $R_f$-methacrylate monomers is analogous to the polymerization of such monomers as described in Houben-Weyl, Methoden der Organichen Chemie, Vol. 14/1, p 1044–1047, (Georg Thieme Verlag, Stuttgart, 1961) or C. E. Schildknecht, Vinyl and Related Polymers, p. 179–255 (John Wiley and Sons, Inc. New York 1952).

Generally polymerization may be carried out in bulk, solution, suspension or emulsion. Solution and emulsion polymerization are preferred.

In emulsion polymerization, the monomer or monomers to be polymerized are emulsified together in a water solution of a surface active agent to a given monomer concentration of from about 5% to about 50%. Usually the temperature is raised to between 40° C. and 70° C. to effect polymerization in the presence of an added catalyst. A suitable catalyst may be of any one of the commonly known agents for initiating the polymerization of an ethylenically unsaturated compound. The concentration of the catalyst for the polymerization is usually between 0.1% and 2% based upon the weight of the monomers.

Suitable surfactants or emulsifying agents include cationic, anionic or non-ionic types. Since the cationic and non-ionic types can be used in most textile treating baths, they are preferred. The hydrophobic portion of the surfactant may be hydrocarbon or fluorinated hydrocarbon.

Suitable surfactants or emulsifying agents include, for example, non-ionic surfactants in which the hydrophilic groups is poly(ethoxy) group and the hydrophobic portion is either a hydrocarbon or a fluorocarbon group such as the ethylene oxide condensates of alkyl phenols, alkanols, alkylamines, alkyl thiols, alkylcarboxylic acids, fluoroalkyl carboxylic acids, fluoroalkyl amines and the like.

Suitable cationic surfactants include for example, quaternary ammonium salts or amine salts containing at least one long chain alkyl, fluoroalkyl, or high alkyl substituted benzene or naphthalene group to provide the hydrophobic portion.

Polymerization is preferably carried out for a reaction period adjusted to obtain essentially quantitative conversion of the fluorinated monomer. The optimum reaction time will depend upon the catalyst used and the polymerization temperature and other conditions, but will generally be in the range of from 0.5 to 24 hours.

The polymerization temperature will depend upon the catalyst chosen. In the case of emulsion polymerization in aqueous media, it will generally be in the range of from 20° C. to 90° C. The polymerization is generally most conveniently and preferably carried out at atmospheric pressure wherever possible.

In solution polymerization, the monomer or monomers are dissolved in a suitable solvent such as fluorinated solvents, for example hexafluoroxylene, trifluorotoluene or mixtures thereof with acetone and/or ethylacetate and polymerized in a reaction vessel using initiators such as azobisisobutyronitrile or other azo initiators at concentrations of 0.1 to 2.0% at 40°–100° C. under nitrogen.

The monomers of formula I may be homopolymerized or co-polymerized with conventional monomers. The conventional monomers may be hydrophilic or hydrophobic or mixtures thereof. In order to impart soil release properties on textile materials, hydrophilic comonomers are advantageously employed. Where both hydrophobic and oleophobic properties are desired, the conventional comonomers are advantageously primarily hydrophobic in character for optimum results. While the amount of the monomer of formula I used in copolymerization with the conventional comonomers can vary widely, depending upon the amount of oleophobicity, and optionally hydrophobicity, desired in the final polymeric finish, advantageously at least about 0.1 weight percent up to about 99.9 weight percent of a monomer of formula I, or mixture thereof, is used per unit weight of conventional comonomers-monomer of formula I blend.

Comonomers useful in the preparation of copolymers of the novel $R_f$ monomers include, without limitation:

Ethylene, and chloro- fluoro-amido and cyano- derivatives of ethylene such as vinyl chloride, vinylidene chloride, vinyl fluoride, acrylonitrile, methacrylonitrile acrylamide, methacrylamide and N,N-dimethylacrylamide, tetrafluoroethylene, hexafluoropropylene. Acrylate and methacrylate monomers, particularly those with 1 to 18 carbon atoms in the ester groups such as n-propyl methacrylate, 2-methyl cyclohexyl methacrylate, methyl methacrylate, t-butyl methacrylate, n-butyl methacrylate, methyl acrylate, ethyl acrylate, propyl acrylate, butyl acrylate, 3-methylpentyl acrylate, octyl acrylate, tetradecyl acrylate, s-butyl acrylate, 2-ethylhexylacrylate, 2-methoxyethyl acrylate, and phenyl acrylate; dienes particularly 1,3-butadiene, isoprene, and chloroprene, 2-fluoro-butadiene, 1,1,3-trifluorobutadiene, 1,1,2,3,-tetrafluoro butadiene, 1,1,2-trifluoro-3,4-dichlorobutadiene and tri- and pentafluoro butadiene and isoprene; nitrogen vinyl monomers such as vinyl pyridine, N-vinylamides, vinyl succinimide, vinyl pyrrolidone, N-vinyl carbazole and the like, styrene and related monomers which copolymerize readily with the novel esters of this invention such as o-methylstyrene, p-methylstyrene, 3,4-dimethyl styrene, m-ethyl styrene, 2,5-diethyl styrene; vinyl esters, e.g. vinyl acetate, vinyl esters of substituted acids, such as for example, vinyl methoxyacetate, vinyl trimethylacetate, vinyl isobutyrate, isopropenyl butyrate, vinyl lactate, vinyl caprylate, vinyl pelargonate, vinyl myristate, vinyl oleate and vinyl linoleate; vinyl esters of aromatic acids, such as vinyl benzoate.

Propylene, butylene and isobutylene are preferred $\alpha$-olefins useful as comonomers with the novel fluoro monomers of the present invention with straight and branched chain $\alpha$-olefins useful with up to 10 carbon atoms in the side chain.

Also useful as comonomers with some of the novel monomers of the present invention are vinyl monomers which contain perfluorinated side chains. Example of such perfluorinated monomers are vinyl esters containing fluoroated alkyl groups disclosed in U.S. Pat. Nos. 2,592,069 and 2,436,144. Other useful monomers are acrylates and methacrylates and derivatives thereof such as those disclosed in U.S. Pat. Nos. 2,628,958; 3,256,230; 2,839,513, 3,282,905; 3,252,932; and 3,304,278.

As mentioned, it may also be desirable to include a minor amount of other reactive comonomers e.g. in order to improve the wash and dry-clean properties of the novel textile finishes obtained according to the practice of this invention. Such monomers act as cross-linking agents during the curing operation and are generally employed in amounts of 0.01% to 5%, preferably 0.1% to 2% by weight, based on the weight of the comonomers.

Reactive monomers which may be included are by way of illustration: acrylic acid, methacrylic acid, acrylamide, methacrylamide, N-methylolacrylamide. 2-hydroxyethyl methacrylate or acrylate, hydroxypropyl acrylate of methacrylate, and t-butylaminoethyl methacrylate, and glycidyl methacrylate. Of the foregoing, N-methylolacrylamide and 2-hydroxyethyl methacrylate are preferred.

Coatings of the homopolymers and copolymers according to the instant invention can be prepared and applied from solvent solutions or from aqueous emulsions. Suitable solvents are fluoroalkanes, fluorochloroalkanes, fluoroalkyl substituted aromatics, alkyl esters of perfluoroalkanoic acids, chlorinated alkanes or aromatics, hydrocarbon aromatics, ketones, esters and esters. Especially useful as solvents are the fluorinated liquids, and especially $\alpha,\alpha,\alpha$-trifluorotoluene, otherwise known as benzotrifluoride, hexafluoroxylene and mixtures of these with ethyl acetate or acetone and the like. Concentrations of the fluorinated polymers of the instant invention in solvent to provide coatings with effective oil and water repellency properties will generally be of the order of 0.01 to 10% and preferably from 0.1 to 2.0% by weight. Blends of the emulsions of the polymers of this invention with blended emulsions of other polymers and copolymers are particularly useful in textile finishes. The polymer and copolymers are generally of a non-fluorinated type; however, as indicated below other fluorinated polymers and copolymers may be used if desired. Nonfluorinated polymers useful in such blends, include for example, but without limitation, polymers and copolymers of alkyl acrylates and alkyl methacrylates, such as methyl methacrylate, ethyl methacrylate, hexyl methacrylate, and n-octyl methacrylate. A particularly suitable polymer is poly-n-octyl methacrylate. Also, useful are polymers and copolymers of acrylic acid, methacrylic acid, styrene, alkyl styrene, butadiene, 2-methyl-1,3-butadiene, 2-chloro-1,3-butadiene, polymers and copolymers of vinyl esters such as vinyl acetate, vinyl butyrate, vinyl laurate, vinyl stearate, vinyl 2-ethyl-hexanoate; polymers and copolymers of vinyl halides and vinyldine halides, such as vinyl chloride, vinylidene chloride, vinyl fluoride, vinylidene fluoride, polymers and copolymers of allyl esters such as allyl propionate or allyl caprylate, polymer and copolymers of vinyl ketones, such as methyl vinyl ether, cetyl vinyl ether, and the like; polymers and copolymers of acrylamide, methacrylamide, N-methylol acrylamide, N-methylol methacrylamide, N-isopropyl acrylamide, and methacrylonitrile.

The polymers of this disclosure possess desirable soil repellency properties. A useful manner of measuring the relative ratings of the polymers is by contact angle measurements of such polymer against water, methylene iodide, and hexadecane.

EXAMPLE 1

4-[Methenyl[bis-1,1,2,2,-Tetrahydroperfluorodecylthio]]-2-methoxy-phenoxycarbonylaminoethyl methacrylate

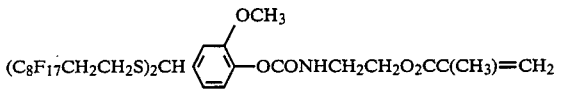

4-[Methenyl[bis-1,1,2,2,-Tetrahydroperfluorodecylthio]]-2-methoxyphenol* (3 g, 2.742 mmol) and 2-isocyanatoethyl methyacrylate (467 mg, 3,016 mmol) were reacted under nitrogen in hexane (15 ml) at 50°-55° C. overnight in the presence of a catalytic amount of triethylamine and dibutyltin dilaurate. The reaction mixture was chilled in an ice-bath, the precipitate filtered, washed with cold hexane and dried to yield 7.98 g (88% of theory) as a white crystalline solid with a melting point of 84° C. NMR showed proton resonances at δ1.99, 3 protons $C(C\underline{H}_3)CH_2$; δ2.94, 8 protons $(C_8F_{17}\underline{CH_2CH_2}S)_2$; δ3.57, 2 protons $NHC\underline{H}_2CH_2O_2C$; δ3.85, 3 protons $COC\underline{H}_3$; δ4.29, 2 protons $NHCH_2C\underline{H}_2O_2C$; δ5.5, 1 proton $S_2C\underline{H}$-C; δ5.69, 1 proton and δ6.19, 1 proton $C(CH_3)C\underline{H}_2$; δ7.00, 1 proton $N\underline{H}$; δ7.13, 2 protons $(C\underline{H})_2$; δ7.29, 1 proton $C\underline{H}C(OCH_3)$.

Analysis for $C_{35}H_{25}F_{34}NO_5S_2$:
Calc: C, 33.6; H, 2.0; N, 1.12; F, 51.7.
Found: C, 34.1; H, 1.9; N, 1.3; F, 52.1.

EXAMPLE 2

2-[2,3-[bis-1,1,2,2-Tetrahydroperfluoroalkylthio]-propyloxycarbonyl]-aminoethyl methacrylate $R_fCH_2CH_2SCH_2CH(SCH_2CH_2R_f)CH_2O_2CNHCH_2CH_2O_2CC(CH_3)=CH_2$ 2,3-[bis-1,1,2,2-Tetrahydroperfluoroalkylthio]-1-propanol* (10.0 g, 21.85 m mol) and 2-isocyanatoethyl methacrylate (3.726 g, 24 mmol) were reacted under nitrogen in hexane (270 ml) at 50°–55° C. overnight in the presence of a catalytic amount of dibutyltin dilaurate. The reaction mixture was chilled in an ice-bath and the product filtered, washed with cold hexane and dried to yield 8.7 g (65.4% of theory) as a white, crystalline solid with a melting point of 55°–56° C., NMR showed proton resonances at δ1.93, 3 protons $C(C\underline{H}_3)CH_2$; δ2.13–3.33, 10 protons $R_f\underline{CH_2CH_2}SCH(\underline{CH_2}S\underline{CH_2CH_2}R_f)$; δ3.47, 2 protons $O_2CNHC\underline{H}_2CH_2$ and 1 protons $SC\underline{H}(CH_2SCH_2CH_2R_f)$; δ4.23, 4 protons $NHCH_2C\underline{H}_2O_2C$ and $CHC\underline{H}_2O_2C$; δ4.87, 1 proton NH; δ5.55 and δ6.11 2 proton $C(CH_3)C\underline{H}_2$.

*U.S. Pat. No. 3,883,596 (Av. mol wt. 457.5)

EXAMPLE 3

Polymer of 2-[2,3-[bis-1,1,2,2-Tetrahydroperfluoroalkylthio]-propyloxycarbonyl]-aminoethyl methacrylate 2-[2,3-[bis-1,1,2,2-Tetrahydroperfluoroalkylthio]-propyloxycarbonyl]-aminoethyl methacrylate (3 g) and 1,1'-Azobis(cyanocyclohexane) (0.1 g) were dissolved in hexafluoroxylene (27 g), purged with nitrogen, sealed into an ampoule under vacuum and polymerized at 95° C. overnight in an agitating bath. NMR showed no proton resonances in the region of δ5–6.5.

EXAMPLE 4

Polymer of 4-[Methenyl-[bis-1,1,2,2-tetrahydroperfluorodecylthio]]-2-methoxy-phenoxycarbonylaminoethyl methacrylate 4-[Methenyl-[bis-1,1,2,2-tetrahydroperfluorodecylthio]]-2-methoxy-phenoxycarbonylaminoethyl methacrylate (1.5 g) and 1,1'-Azobis(cyanocyclohexane) (0.075 g) were dissolved in hexafluoroxylene (13.5 g), purged with nitrogen, sealed into an ampoule under vacuum and polymerized at 95° C. overnight in an agitating bath. NMR showed no proton resonances in the region of δ5–6.5.

| | Contact Angles (ϕ) | | | | | | |
|---|---|---|---|---|---|---|---|
| | $\phi H_2O$ | $\phi CH_2I_2$ | $\phi C_{16}$ | $\gamma_s^d$ | $\gamma_s^p$ | $\gamma s$ | $\gamma c$ |
| Example 3 | 104 | 87 | 70 | 12.6 | 2.4 | 15.0 | 16 |
| Example 4 | 108 | 91 | 70 | 11.1 | 1.8 | 12.9 | 14 |

I claim:

1. A monomer of the formula

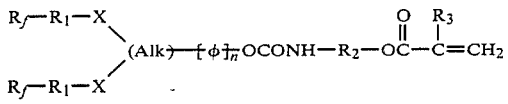

(I)

where $R_f$ is perfluoroalkyl, omega-hydroperfluoroalkyl, or perfluoroalkoxy substituted perfluoroalkyl;
$R_1$ is alkylene of up to 12 carbon atoms;
X is —S— or —$SO_2$—;
Alk is alkanetriyl having from 1 to 12 carbon atoms;
ϕ is phenylene which is unsubstituted or substituted by chlorine, bromine, alkyl of 1 to 6 carbon atoms or alkoxy of 1 to 6 carbon atoms;
n is 0 or 1;
$R_2$ is alkylene of up to 12 carbon atoms; and
$R_3$ is hydrogen or methyl.

2. A monomer according to claim 1, wherein $R_f$ contains up to 18 carbon atoms.

3. A monomer according to claim 2, wherein $R_f$ contains from 3 to 12 carbon atoms.

4. A monomer according to claim 3, wherein $R_f$ contains from 6 to 12 carbon atoms.

5. A monomer according to claim 3 wherein $R_f$ is perfluoroalkyl.

6. A monomer according to claim 4, wherein $R_2$ is alkylene of 2 to 6 carbon atoms.

7. A monomer according to claim 5, wherein $R_2$ is alkylene of 2 to 6 carbon atoms.

8. A monomer according to claim 4, wherein $R_3$ is methyl.

9. A monomer according to claim 1, wherein X is —S—.

10. A monomer according to claim 3, wherein Alk is alkanetriyl of 1 to 7 carbon atoms and n equals 1.

11. A monomer according to claim 3, wherein Alk is

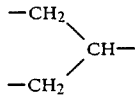

wherein the $R_f$—$R_1$—X— groups are attached to the —$CH_2$— moieties.

12. A monomer according to claim 3, wherein Alk is alkanetriyl of 2 to 14 carbon atoms, the $R_f$—R—X— groups are attached to the same carbon atom, and n is zero.

13. A monomer according to claim 3, wherein Alk is alkanetriyl of 3 to 14 carbon atoms and the $R_f$—$R_1$—X— groups are attached to adjacent carbonatoms.

14. A monomer according to claim 10, wherein X is —S—.

15. A monomer according to claim 12, wherein X is —S—.

16. A monomer according to claim 13, wherein X is —S—.

* * * * *